United States Patent [19]

Ehrhart

[11] 4,033,583

[45] July 5, 1977

[54] TENNIS RACKET

[76] Inventor: Wendell A. Ehrhart, 160 Schoolhouse Lane, Hellam, Pa. 17406

[22] Filed: Mar. 16, 1976

[21] Appl. No.: 667,286

[52] U.S. Cl. ..... 273/73 R; 273/73 J

[51] Int. Cl.[2] ..... A63B 49/08

[58] Field of Search ..... 273/67 D, 67 DA, 72 R, 273/73 R, 73 J, 75, 81 R, 81 C

[56] References Cited

UNITED STATES PATENTS

| | | | |
|---|---|---|---|
| 2,044,567 | 6/1936 | Daday | 273/81 C |
| 2,225,839 | 12/1940 | Moore | 273/81 C |
| 3,534,960 | 10/1960 | Hanks | 273/75 |
| 3,804,413 | 4/1974 | Hrivnak | 273/81 C |

FOREIGN PATENTS OR APPLICATIONS

| | | | |
|---|---|---|---|
| 1,112,435 | 8/1961 | Germany | 273/75 |
| 710,625 | 6/1954 | United Kingdom | 273/73 J |
| 808,614 | 2/1959 | United Kingdom | 273/73 J |

*Primary Examiner*—Richard J. Apley

[57] ABSTRACT

A tennis racket or the like having a slip clutch in the handle of the racket. When a tennis ball strikes on or near the frame to the side of the tennis racket head, there is a tendency for the head of the racket to twist around a longitudinal axis extending through the handle of the racket. The slip clutch permits the head of the racket to rotate relative the handle of the racket to lessen the transmission of shock forces from the head of the racket to the arm of the user of the tennis racket.

5 Claims, 4 Drawing Figures

TENNIS RACKET

BACKGROUND OF THE INVENTION

1. Field of the Invention

The present invention relates to an improved tennis racket and, more particularly, to a tennis racket which is designed to help tennis players suffering from tennis elbow.

2. Description of the Prior Art

U.S. Pat. No. 3,690,659 is directed to a tennis racket construction having a central dampening core sandwiched between skins of high strength material.

U.S. Pat. No. 1,523,638 is directed to a tennis racket having a handle with a highly resilient soft cover which will yieldingly engage the hand of the user to prevent abrasion thereto.

U.S. Pat. No. 3,606,326 is directed to a handle of a game-striking instrument wherein the handle is covered by a superimposed layer of a foamed, sponged elastomer to form an improved grip.

Finally, U.S. Pat. No. 3,311,375 is directed to a grip of a striking instrument which is covered with a resilient cellular material covered by a thin layer of a resilient sheet material.

One who is suffering from a tennis elbow condition will find that the condition is aggravated by shock actions which are transmitted from the head of the tennis racket to the forearm muscles of the user of the racket. Resilient flexible tennis racket structures have been developed for the purpose of absorbing the shock action of a tennis racket to lessen the transmission of the shock to the user of the racket. To date there is no teaching in the prior art of using an adjustable slip clutch arrangement which will permit certain shocks developed in the head of the tennis racket to be dissipated through the slip clutch, rather than transmitted through the handle of the tennis racket to the muscles and tendons in the forearm of the user of the tennis racket.

SUMMARY OF THE INVENTION

The invention is directed toa tennis racket which has the conventional head portion with an open frame and strings positioned therein. A handle is attached of the head portion and the handle is made in two parts. The first part of the handle is attached to the head portion of the tennis racket. The second part of the handle is grasped by the user of the tennis racket. Between the two parts of the handle, a friction clutch is positioned. The clutch is made adjustable and will, under some circumstances, permit rotation of the head of the tennis racket relative to the portion of the handle of the tennis racket held by the user of the tennis racket.

Therefore, when the tennis ball strikes the frame of the head of the tennis racket sufficiently far to the side of the center line of the tennis racket, the torque developed around the center line of the tennis racket is not now transmitted to the hand of the user of the tennis racket, but is dissipated through the slip clutch. This lessens the shock action being transmitted to the muscles of the forearm of the user of the tennis racket and, therefore, lessens the aggravation of the tennis elbow condition from which the user of the tennis racket may be suffering.

DESCRIPTION OF THE PREFERRED EMBODIMENTS

The invention herein consists of a shock absorbing grip for a tennis racket which allows tennis elbow sufferers to play tennis with minimal aggravation to their injury. Presumably, such a grip would prevent the development of tennis elbow in at least some people not already afflicted. There is a tendency to try to hold a tennis racket rigid on hits far to the side of the center of the head of the racket. Some hits on the frame of the head of the tennis racket will be four to five inches off center from the longitudinal axis of the tennis racket. This creates a substantial torque which creates a shock that is transmitted down the handle of the tennis racket to the user's fingers, wrist, and ultimately to the tendon-bone junction on the outside of the elbow. These strikes by the tennis ball to the frame of the head of the tennis racket are one of the prime sources of pain that is encountered by one who has a tennis elbow. The slip clutch, in the above situation, permits the head of the tennis racket to rotate relative the longitudinal axis of the tennis racket, and this limits the transmission of shock through the handle of the tennis racket into the hand and forearm of the user of the tennis racket. If the slip clutch is made adjustable, the clutch could be left loose for practice, but tightened up during an important match.

Figure 1:
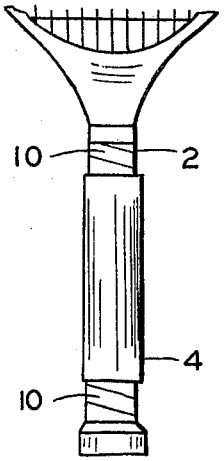
FIG. 1 is a partial view of a tennis racket.
Figure 2:
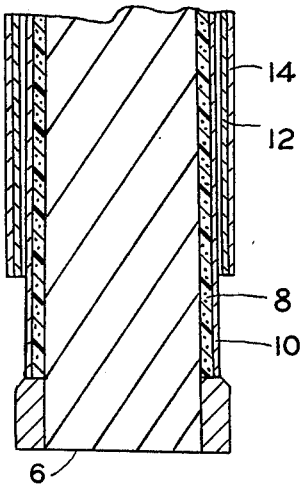
FIG. 2 is an enlarged cross-sectional view of the handle of the tennis racket of FIG. 1 showing the details of the slip clutch therein.

In the preferred embodiment of the invention, as shown in FIG. 1, the slip clutch exists between the handle 2 of the tennis racket and the sleeve 4 of the tennis racket which is grasped by the user of the tennis racket. Referring now to FIG. 2, there is shown in detail the slip clutch structure of FIG. 1. A conventional handle 2 of a tennis racket has a shaft 6 with a grip section which is tapered so that it has a slightly larger diameter at its base relative to its diameter up nearer the head of the tennis racket. It is this taper in the grip section of the handle 6 that, as will be explained later, provides for an adjustment in the slip clutch.

Around the wood handle 6 there is a high density, moderately plasticized poly (vinyl chloride) foam 8 which is about one tenth of an inch in thickness. The foam is semisoft and has a leathery, rather than a rubbery or rigid, hand. Such material is known to have a high hysteresis or good vibration dampening characteristic. A particularly good poly (vinyl chloride) foam to use is one that has a Shore A durometer hardness of about 46 with about 55 parts of plasticizer per 100 parts of poly (vinyl chloride) resin. This foam 8 functions to help absorb shock waves developed in the racket head.

The normally available leather grip on the wood handle 6 is removed and a piece of the foam 8 is placed thereon. This is secured in place with one to two layers of plastic electrical tape 10. Typical of the tape that could be utilized is 3M No. 33+ electrical tape which provides a low friction, smooth surface covering over top of the foam 8. This layer of tape is wrapped around the foam from the bottom of the foam to the top of the foam and covers the complete grip section of the handle structure, as shown in FIG. 1.

On top of this placed a piece of 0.003 inch thick Mylar, a polyester plastic film of Dupont. This is cut so that it just fits around the foam without an overlap. This film 12 is wrapped around the handle so that the lower edge of the film is about 1½ inches higher than the bottom edge of the foam. Tape 14 is then wrapped around the Mylar to hold its edges together. Overtop of this, or as part of the tape, a friction wrapping is provided so that a good hand grip surface is formed. A powder, such as talc or baby powder, could be sprinkled between the smooth surface friction tape 10 over the foam and the Mylar film 12. By moving the Mylar film up and down the handle of the tennis racket, it is possible to adjust the slip clutch. As the Mylar film is forced down on the handle of the tennis racket, the frictional contact between the Mylar film 12 and the friction tape 10 increases as the foam is compressed, giving a very tight fit. This results from the tapered configuration of the wood handle 6, which is larger at the base of the tennis racket handle. Moving the Mylar upward on the handle of the tennis racket decreases the frictional contact between the Mylar film and friction tape 8, and thus creates a very loose friction clutch which will permit the tennis racket to rotate along the longitudinal axis of the handle thereof when a relatively small rotational force is applied to the racket head. The Mylar sleeve forms the second part of the handle structure, and it is this part which is meant to be grasp by the user of the tennis racket. The tape-wrapped foam on the wood handle of the tennis racket forms the handle portion of the tennis racket. The spacing therebetween forms the friction clutch, which is adjustable because the frictional contact between the two parts can be adjusted by sliding the Mylar sleeve up and down the tapered handle of the tennis racket.

For practice, where it is desirable that minimum stress be placed upon the arm, the Mylar sleeve will be kept relatively loose on the handle of the tennis racket so that the tennis racket may twist relative the hand-held sleeve whenever small twisting action is applied to the head of the tennis racket. In competition matches where it is desirable to have a greater control over the head of the tennis racket, the Mylar sleeve can be slid down the handle of the tennis racket to greatly increase the frictional contact between the first and second parts of the handle, and thus minimize the tendency for the head of the tennis racket to twist relative to the Mylar sleeve when the head of the tennis racket is struck by a ball of center from the longitudinal axis of the tennis racket.

Figure 3:
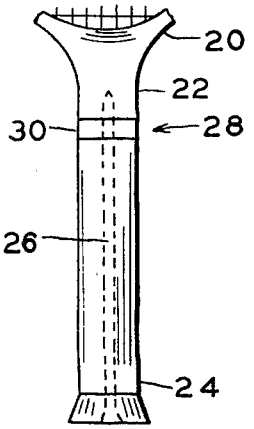
FIG. 3 is a modified slip clutch structure.

It is obvious that a slip clutch structure could be provided by other means. In FIG. 3 is shown a modified structure wherein the head 20 of the tennis racket is connected to handle portion 22. The second handle portion 24 is connected to the first handle portion 22 by a long screw 26. At the interface 28 between handle portion 22 and 24, there is placed a disc 30, which will function as a friction clutch. The disc 30 could be a rubber material, and depending upon how tight screw 26 holds handle portion 24 relative to handle portion 22, the frictional contact between the handles and disc 30 can be varied.

Figure 4:
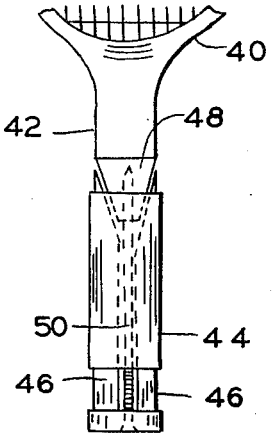
FIG. 4 is another modified version of a slip clutch structure.

FIG. 4 discloses another slip clutch arrangement wherein the head 40 is connected to a first handle portion 42. The sleeve 44 forms the second handle portion. The lower part of handle 42 is formed of two wedge elements 46 which engage a tapered cone 48. Screw 50 forces the wedge members 46 up against the tapered cone 48 and thus varied the diameter of the handle element 42. This in turn affects the frictional contact between handle 42 and handle portion 44.

It is obvious that other structures could be utilized to create a friction clutch in the handle of a tennis racket. The essence of the invention herein is to have a part of the handled grasped by the user and the head of a tennis racket being pivotal thereto around the longitudinal axis of the tennis racket handle so that objectionable twisting actions applied to the head of the tennis racket will not be fully transmitted to the handle of the tennis racket and then, consequently, to the forearm of the user of the tennis racket to aggravate a tennis elbow condition.

What is claimed is:

1. A racket comprising:

a. a head portion having an open frame and strings positioned within the open frame, b. a handle portion attached to said head portion, 1. said handle portion being formed of two parts with a friction clutch means therebetween, said friction clutch means being adjustable to vary the frictional contact between the two parts and permitting a variable degree of rotation of one part relative the other part to absorb shock action,
2. one part of the handle portion being connected to said head portion,
3. the second part of the handle portion being adapted to be grasped by the user of the racket, and
4. said friction clutch means being between said two handle parts, said clutch means being constructed and arranged to permit the head portion of the racket to rotate about the axis of the handle portion when a ball strikes the side of the racket head.

2. The racket of claim 1 wherein the second part of the handle portion constitutes a sleeve surrounding the first part of the handle structure which is connected to the head of the racket, said first part of the handle portion being of a varied cross section along its length so that the sleeve means may be slid up and down along the first part of the handle portion to adjust the frictional contact between the two parts of the handle, said frictional clutch being the interface between the two parts of the handle structure.

3. The racket according to claim 2 wherein the first part of the handle structure includes a foam material covering which is compressed by the sleeve to assist in the adjustment of the frictional contact between the sleeve and the first part of the handle structure.

4. The racket according to claim 1 wherein the second part of the handle portion is a sleeve and the first part of the handle portion is an expandable cross-section structure fastened to the head of the racket, said expandable portion of the handle being composed of wedge elements which engage a cam surface to vary the effective cross-sectional size of the first part of the handle portion, and the friction clutch is the interface between the first part and the second part of the handle portion.

5. The racket according to claim 1 wherein the second part of the handle portion is a conventional racket handle and the first part of the handle portion of the racket is a portion of the head of the racket, and a disc-shaped friction element is positioned between said two handle portions, said disc-shaped element being the frictional clutch will permit the head of the racket to rotate relative the handle of the racket.

* * * * *